United States Patent [19]

Kobler

[11] Patent Number: 4,475,093

[45] Date of Patent: Oct. 2, 1984

[54] POLARIZED ELECTROMAGNETIC RELAY

[75] Inventor: Ulrich Kobler, Munich, Fed. Rep. of Germany

[73] Assignee: Siemens Aktiengesellschaft, Berlin & Munich, Fed. Rep. of Germany

[21] Appl. No.: 409,626

[22] Filed: Aug. 19, 1982

[30] Foreign Application Priority Data

Sep. 4, 1981 [DE] Fed. Rep. of Germany ..... 3135171

[51] Int. Cl.[3] ..... H01H 51/22; H01H 51/27

[52] U.S. Cl. ..... 335/78; 335/125; 335/234; 335/276

[58] Field of Search ..... 335/78, 79, 80, 81, 335/84, 85, 124, 125, 203, 229, 230, 234, 235, 266, 276

[56] References Cited

U.S. PATENT DOCUMENTS

| | | | |
|---|---|---|---|
| 3,946,347 | 3/1976 | Sauer | 335/125 |
| 3,993,971 | 11/1976 | Ono et al. | 335/125 |
| 4,339,735 | 7/1982 | Ono et al. | 335/125 |

FOREIGN PATENT DOCUMENTS 724978 2/1955 United Kingdom .

*Primary Examiner*—E. A. Goldberg
*Assistant Examiner*—George Andrews
*Attorney, Agent, or Firm*—Hill, Van Santen, Steadman & Simpson

[57] ABSTRACT

A polarized electromagnetic relay has two L-shaped yokes with a permanent magnet disposed therebetween. Each yoke has a long leg and a short leg with a coil wound around the long legs of the yokes. The long leg of a similarly L-shaped armature is also disposed between the long legs of the yokes and the armature is pivotally mounted at its short leg so that the free end of the long leg of the armature executes switching movements between the short yoke legs and forms a rectangle in combination with the yoke arrangement. The armature may be mounted centrally or single-sided with respect to the yoke legs for monostable or bistable switching behavior of the relay. The compact arrangement of the yokes and armature permits a number of contact elements to be disposed beneath the coil at both sides of the long armature leg, with the armature causing movement of spaced spring contact elements for making and breaking with corresponding fixed contact elements.

30 Claims, 18 Drawing Figures

POLARIZED ELECTROMAGNETIC RELAY

BACKGROUND OF THE INVENTION

1. Field of the Invention

The present invention relates to polarized electromagnetic relays, and in particular to a polarized electromagnetic relay having a particularly compact arrangement of the yokes and armature.

2. Description of the Prior Art

A polarized electromagnetic relay having a magnet system consisting of two spaced angled yokes disposed parallel to one another with a permanent magnet disposed therebetween is described, for example, in German Pat. No. 966,845 corresponding to British Pat. No. 724,978. In this known magnet system, one leg of the yoke arrangement has an excitation coil wound thereabout and an armature mounted outside of the coil is disposed with at least one movable end between the parallel free ends of the two yokes comprising the yoke arrangement. The yokes are U-shaped and the armature is pivotally mounted so that when the coil is energized the armature is attracted to one of the yokes such that the opposite end of the armature moves in the opposite direction about the pivot point. Such a U-shaped yoke arrangement, however, cannot be subsequently introduced into a completed and wound coil body and in practice the coil body must be manufactured in two joinable parts which are assembled around the yoke arrangement and subsequently wound with magnet wire.

A U-shaped yoke arrangement is also known in the art having a central portion and a permanent magnet disposed between the yoke elements situated beneath the coil. Such a yoke arrangement is utilized with a bar-shaped armature which extends through the inside of the coil between the free ends of the yoke legs. Contact actuation is undertaken by means of a slide element disposed on the armature between the coil flange and the free yoke legs; the slide element actuating contact springs is disposed at opposite sides of the coil. This arrangement, however, does not make optimum use of the available space because the contact elements disposed at opposite sides of the coil are at the same level as the armature and thus require relatively long leads.

SUMMARY OF THE INVENTION

It is an object of the present invention to provide a polarized electromagnetic relay having a yoke arrangement consisting of two spaced parallel yoke elements with a permanent magnet disposed therebetween and an armature movable between the yoke elements wherein all parts of the relay are easy to manufacture and to assemble.

It is a further object of the present invention to provide such a polarized electromagnetic relay which can be easily adapted for monostable or bistable switching behavior.

Another object of the present invention is to provide a magnetic circuit arrangement for use in a relay which simultaneously achieves optimum use of the available space within the magnetic circuit and which is utilized in combination with a contact arrangement actuatable by means of the armature.

A further object of the present invention is to provide an electromagnetic relay having a resolution sensitivity which can be easily adjusted by means of magnetic equalization in the finished relay.

The above objects are inventively achieved in a polarized electromagnetic relay wherein the yoke elements are L-shaped and each have a long leg extending through a coil body and a short leg extending outside the coil body. The armature is similarly L-shaped and has a long leg which extends outside the coil body terminating in a free end which is movable between the short spaced legs of the yoke elements. The short leg of the L-shaped armature is utilized for pivotally mounting the armature such that the armature and yokes form a rectangular arrangement. The long armature leg is disposed substantially parallel to the long yoke legs and the short armature leg is disposed perpendicular to the coil axis and forms the axis of rotation for the armature.

The yoke arrangement described above including the permanent magnet can be easily plugged into a completed and wound coil body from one flange side of the coil body, with the armature being seated at the opposite side of the coil body at the other coil flange. The long free leg of the armature extends outside of the coil substantially parallel to the coil axis up to and between the two free yoke ends. The free armature leg thus is disposed below the coil, as viewed from the connection plane of the relay, so that the contact elements disposed next to the armature require only short feed-through leads to the terminal pins. This structure has the advantage of a small space requirement and exhibits low contact circuit resistances.

In one embodiment of the invention, the long legs of the two L-shaped yokes extend through the interior of the coil so as to enclose one end of the armature between the free ends of the short legs of the yokes. The permanent magnet is thus disposed inside the coil between the two yoke legs and extends substantially along the entire yoke length. The free surface between the two yoke elements is thus optimally exploited. The two yoke elements comprising the yoke arrangement and the armature may have identical dimensions thereby permitting the yoke elements and the armature to be selected from a batch of identical parts without the need for differentiation.

In an embodiment of the invention for bistable switching, the short armature leg is seated centrally between the ends of the long yoke legs. In order to increase the sensitivity of the relay, the two long yoke legs may be bent toward the armature in the region of the coupling surfaces of the yoke legs with the armature. By so doing, the magnetic resistance of the excitation circuit is reduced. The simultaneously increased shunt for the permanent magnet can be compensated without difficulty by means of the relatively large permanent magnet which can be utilized in this structure, which may occupy the entire coil lenth.

In an embodiment of the relay for monostable switching, the short armature leg is preferably seated at one end of one long yoke leg. In order to precisely fix the monostable switching characteristics, and thus the response sensitivity of the relay, the short yoke leg may have a pole surface which is of a different size in comparison to the pole surface of the long armature leg. In order to guarantee a high response sensitivity in monostable switching, the yoke leg which determines the rest position of the armature may, for example, have a smaller pole surface, whereas the opposite yoke leg effects a high attractive force due to a larger pole surface in the working position of the armature.

In another embodiment of the invention the armature may have a long leg having a bent cross-section proceeding below the coil in order to achieve a small overall height of the relay without sacrificing the conduction of a sufficient amount of magnetic flux. This structure is particularly useful in combination with a yoke arrangement wherein one of the yoke legs is shortened to form a smaller pole surface, so that the bent portion of the armature is movable to lie below the shortened yoke leg.

A simplified embodiment of the inventive relay has a yoke arrangement wherein only one of the yoke elements has perpendicular legs, one of which extends through the interior of the coil. In this embodiment the other yoke element has only one leg which is disposed outside of the coil and which extends parallel to the short leg of the first yoke and forms a second pole surface relative to the armature. In this embodiment the permanent magnet is disposed outside of the coil between the two yoke elements. In order to enlarge the pole surfaces between the two yoke elements outside of the coil, the short yoke leg may, for example, be lengthened along the coil flange such that the first yoke element exhibits a T-shape. Monostable switching behavior is obtained with this structure, however, the switching behavior is less sensitive than in the previously-described monostable embodiment.

The polarized electromagnetic relay disclosed and claimed herein may employ any one of several embodiments for mounting the armature. In all of the embodiments the short leg of the armature is seated with respect to the coil body by means of a bearing spring. The bearing spring may be U-shaped, in which case the central portion of the bearing spring is connected to the armature and the lateral parallel legs of the bearing spring are secured in recesses in the coil body. The lateral legs may be secured in the coil body recesses by means of resilient latching tabs. In another embodiment, the bearing spring may be essentially planar, with the central portion of the spring again carrying the armature. In this embodiment the bearing spring has spaced apertures at opposite sides of the central portion of the spring which engage deformable pegs mounted on the coil body. The apertures in the bearing spring are preferably in the form of oblong holes in order to permit position adjustment for tolerance balancing during assembly of the relay.

In the monostable embodiments of the relay, the armature and bearing spring are mounted at one side of one of the yoke elements. The armature may be easily mounted on the bearing spring to achieve monostable or bistable switching behavior easily by simply attaching the armature by means of welding or other suitable securing means on the bearing spring either centrally or offset with respect to the center of the bearing spring.

The coil body is mounted on a base body consisting of insulating material disposed below the coil, with the coil body and base body being connected by means of interconnecting passages and deformable pegs. Contact terminals can easily be plugged into the base body or may be anchored therein by means of embedding. In one embodiment of the relay the terminal elements are stamped from a blank piece of stock and are embedded in common in one plane, with selected ones of the thus exposed sections of the connection elements being either bent downwardly to form terminal pins or lugs at the lower side of the base body or bent upwardly to form contact carriers on the upper side of the base body. In order to obtain precise spacings between the short legs of the yoke elements, which limit the armature stroke, and the contact carriers, at least one of the short yoke legs is engaged in a recess in the based body and rests against a seating wall of said recess so as to precisely position the short yoke leg, and thus the entire yoke arrangement, with respect to the contact carriers.

The base body may have one or more receptacles or pockets for receiving getter material in the area of the contact elements. The getter material may be liquid which subsequently congeals in the getter receptacle, or may be a solid getter tablet in which case the receptacle may be provided with spaced ribs for supporting the tablet.

The armature has a slide element mounted thereon for comovement with the armature for engaging and moving contact springs or blades for causing the contact springs to make and break with stationary contact elements. The slide element is extrusion coated with insulating material. In order to guarantee forced contact movement in both directions, rather than relying solely upon the spring characteristics of the contact spring for releasing the spring upon de-energization of the coil, the slide element may be provided with noses or slots for engaging the contact springs.

DESCRIPTION OF THE PREFERRED EMBODIMENTS

Figure 1:
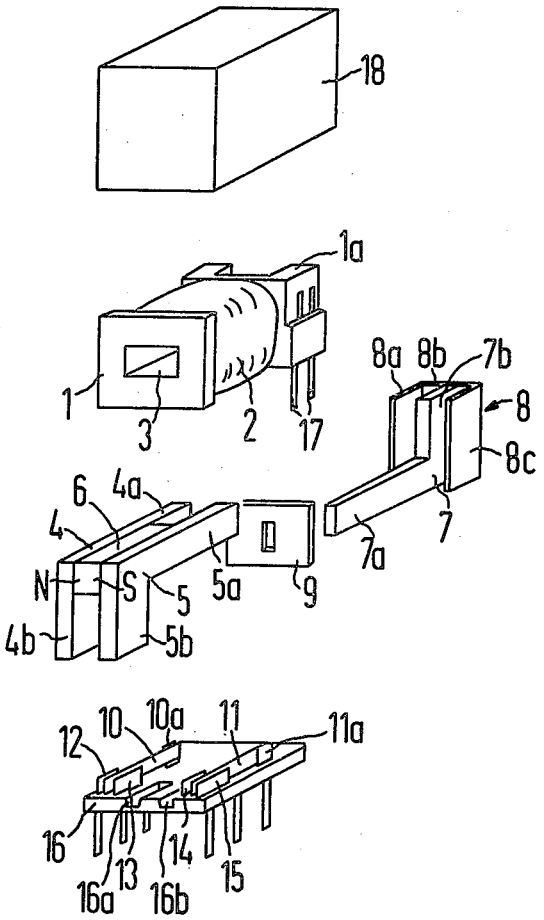
FIG. 1 is an exploded view of a polarized electromagnetic relay constructed in accordance with the principles of the present invention.

A simplified exploded view of a polarized electromagnetic relay constructed in accordance with the principles of the present invention is shown in FIG. 1. The relay includes a coil body 1 having a coil 2 wound thereabout and having an axial opening 3 extending through the coil body 1. The relay further includes a yoke arrangement consisting of two spaced parallel L-shaped yoke elements 4 and 5 having respective long legs 4*a* and 5*a* and respective short legs 4*b* and 5*b*. A permanent magnet 6 is disposed between the yoke elements 4 and 5 and is polarized in a direction perpendicular to the interior faces of the yoke elements so as to form a pole surface in combination with the two yoke elements. The long yoke legs 4*a* and 5*a* together with the permanent magnet 6 are inserted into the opening 3 of the coil body 1, so that the free ends of the yoke legs 4*a* and 5*a* are disposed at the coil flange 1*a* and accept the short leg 7*b* of an armature 7 therebetween.

The armature 7 is also L-shaped and during assembly is disposed between the yoke elements 4 and 5 so as to approximately form a rectangle in combination therewith when viewed from the side. As stated above, the short armature leg 7*b* is disposed between the free ends of the long yoke legs 4*a* and 5*a* and, in combination therewith, forms magnetic coupling surfaces. The armature 7 also has a long armature leg 7*a* which extends outside of the coil 2 and terminates in a free end disposed between the free ends of the short yoke legs 4*b* and 5*b* and forms working air gaps with respect thereto.

The length of the permanent magnet 6 in the polarizing direction between the two yoke elements 4 and 5 is selected such that the permanent magnet 6 rests against the yoke elements 4 and 5 at both sides and, minus the armature thickness, fixes the armature stroke between the short yoke legs 4*b* and 5*b*. Because the armature has a smaller thickness than the spacing between the two yoke elements 4 and 5, the permanent magnet 6 is not short-circuited. On the contrary, as stated above, respective air gaps remain between the long leg 7*a* of the armature 7 and the yoke legs 4*b* and 5*b* which, as described below, may vary in size. A bistable switching characteristic of the relay is achieved by central disposition of the armature with respect to the yoke elements 4 and 5 and monostable switching behavior of the relay is achieved by single-sided mounting of the armature so as to couple the armature to one yoke leg.

The armature 7 is seated at the coil flange 1*a* by means of a U-shaped bearing spring 8, having a central portion 8*b* connected to the short leg 7*b* of the armature 7 and two arms 8*a* and 8*c* for securing the bearing spring 8 to the flange 1*a*. By mounting in this manner the armature exhibits a rotational axis extending perpendicular to the coil axis in the direction of the short armature leg 7*b* and permits movement of the long armature leg 7*a* between the yoke legs 4*b* and 5*b*.

A contact slide 9, which may be force-fit onto the armature leg 7*a* or may be formed thereon by means of extrusion coating, is comovable with the armature and actuates two contact springs 10 and 11 which respectively form switching contacts in combination with stationary pairs of contact elements 12 and 13, and 14 and 15. The contact elements 12, 13, 14 and 15, as well as spring carriers 10*a* and 11*a*, are embedded or plugged into a base body 16. The base body 16 carries the coil body 1 together with the yokes 4 and 5 and the armature 7. In order to achieve precise spacings between the final positions of the armature and the contact elements, recesses 16*a* and 16*b* are provided in the base body 16 for receiving the free ends of the short yoke legs 4*b* and 5*b* which are inserted therein. The coil flange 1*a* is also seated on the base body 16 and may be connected thereto by similar means in order to fix its position. The coil body 1 has terminal pins 17 which are inserted through corresponding apertures in the base body 16 during assembly. A protective cap 18 is inverted over the coil body 1 and the base body 16 with the seam between the base body 16 and the cap 18, as well as the passages of the terminal pins, being sealed with casting resin.

Figure 2:
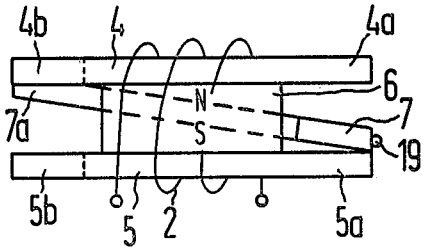
FIG. 2 is a schematic illustration of a magnetic circuit for an embodiment of an electromagnetic relay constructed in accordance with the principles of the present invention for monostable switching behavior.

FIGS. 2 through 5 schematically show various embodiments of the magnetic system for the relay disclosed and claimed herein. The embodiment shown in FIG. 2 is for monostable switching, wherein the armature 7 is disposed between the yoke elements 4 and 5 and is seated at one side at the bearing location 19 next to the yoke leg 5*a*. The armature 7 assumes a diagonal rest position as shown in FIG. 2 due to the polarization of the permanent magnet 6 directed between the two yoke elements 4 and 5 so that the free end of the armature leg 7*a* rests against the short yoke leg 5*b*. The armature is switched by means of energizing the coil 2 so as to move flat against the yoke 5.

Figure 3:
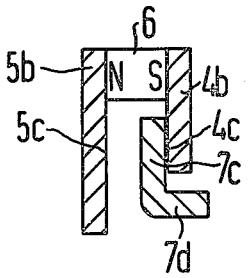
FIG. 3 is an end view of an embodiment of a magnetic circuit constructed in accordance with the principles of the present invention for monostable switching behavior with a modified armature.

Another embodiment of the magnet system of the relay is shown in FIG. 3 which increases the sensitivity of the monostable switching behavior of the relay. In this embodiment the short yoke legs 4*b* and 5*b* are of different lengths, and the long leg of the armature is angled to form perpendicular arms 7*c* and 7*d*. The arm 7*d* in the rest position is disposed beneath the shorter of the two short legs of the yoke elements, which in the embodiment of FIG. 3 is the leg 4*b*. The pole surface 4*c* against which the armature arm 7*c* rests in the rest position is smaller than the pole surface 5*c* for the work side of the armature. By angling the long leg of the armature so as to form the two arms 7*c* and 7*d*, the sufficiently large cross-section of the armature is retained without increasing the overall height of the relay.

Figure 4:
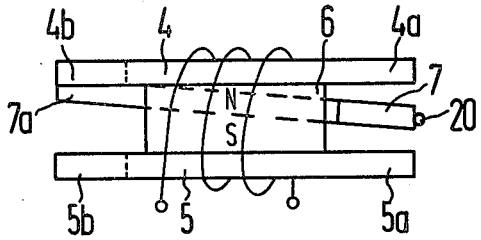
FIG. 4 is a plan view of a magnetic circuit constructed in accordance with the principles of the present invention for use in a polarized electromagnetic relay for bistable switching behavior in a first embodiment.

An embodiment of a magnetic system for use in a polarized electromagnetic relay with bistable switching behavior is represented in FIG. 4. In this embodiment the armature 7 is centrally seated between the yoke legs 4*a* and 5*a* at a bearing point 20. The free end of the long leg 7*a* of the armature selectively assumes one of two stable switch positions either at the yoke leg 4*b* or at the yoke leg 5*b*.

Figure 5:
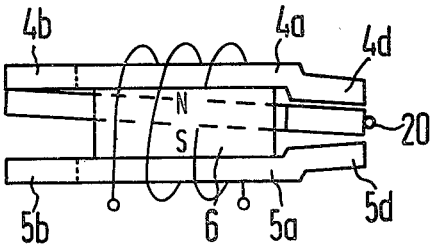
FIG. 5 is a plan view of a magnetic circuit constructed in accordance with the principles of the present invention for use in a polarized electromagnetic relay for bistable switching behavior.

A modification of the bistable switching system is shown in FIG. 5 wherein the yoke legs 4*a* and 5*a* are each bent toward the armature bearing point 20 at respective ends 4*d* and 5*d* so as to reduce both the magnetic coupling to the armature and the magnetic resistance in the circuit at both sides. An air gap still is retained in this embodiment between the armature 7 and the yoke legs 4 and 5 so that sufficient permanent magnetic flux is available for achieving the desired contact force at the short yoke legs 4*b* and 5*b*. As needed, the short yoke legs 4*b* and 5*b* may also be bent with respect to the armature 7 so as to achieve larger or smaller working air gaps.

Figure 6:
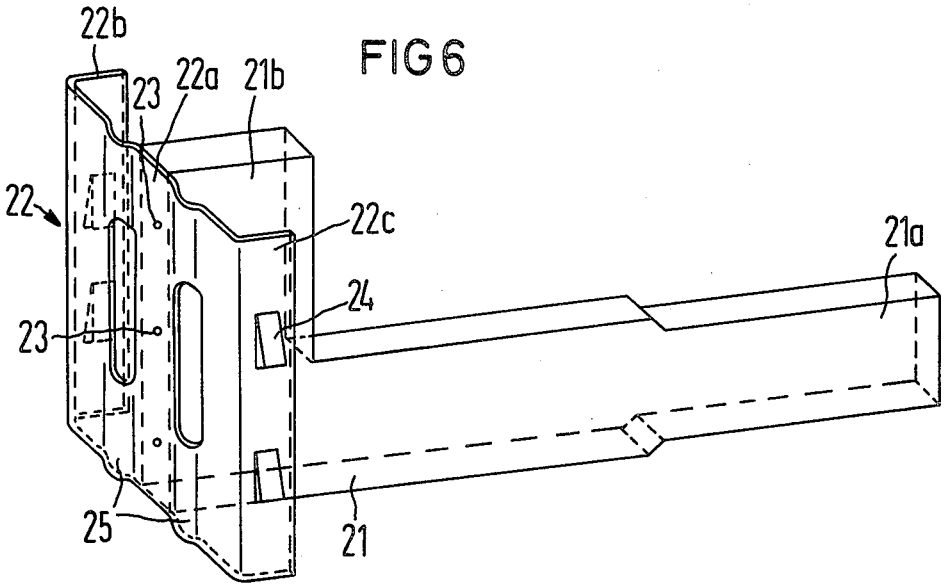
FIG. 6 is a perspective view of a first embodiment of an armature and bearing spring constructed in accordance with the principles of the present invention.

A detailed view of an L-shaped armature 21 having a long leg 21*a* movable between the yoke legs is shown in FIG. 6. The armature 21 is secured at a short leg 21*b* to a bearing spring 22. The bearing spring is U-shaped and is connected to the armature leg 21*b* at a central portion 22*a* by means of, for example, weld connections 23. The bearing spring has lateral arms 22*b* and 22*c* which can be inserted into recesses in the coil body 1 and retained therein by resilient latching tabs 24. In the bistable embodiment, the armature 21 is secured in the center of the central portion 22*a* of the bearing spring 22 as shown in FIG. 6, however, it will be understood that the armature 21 may be easily adapted for monostable switching behavior by mounting the armature leg 21*b* asymmetrically with respect to the bearing spring 22 as shown in FIG. 2. In order to improve the resiliency of the bearing spring 22, the spring is provided with impressed spaced ridges 25.

Figure 7:
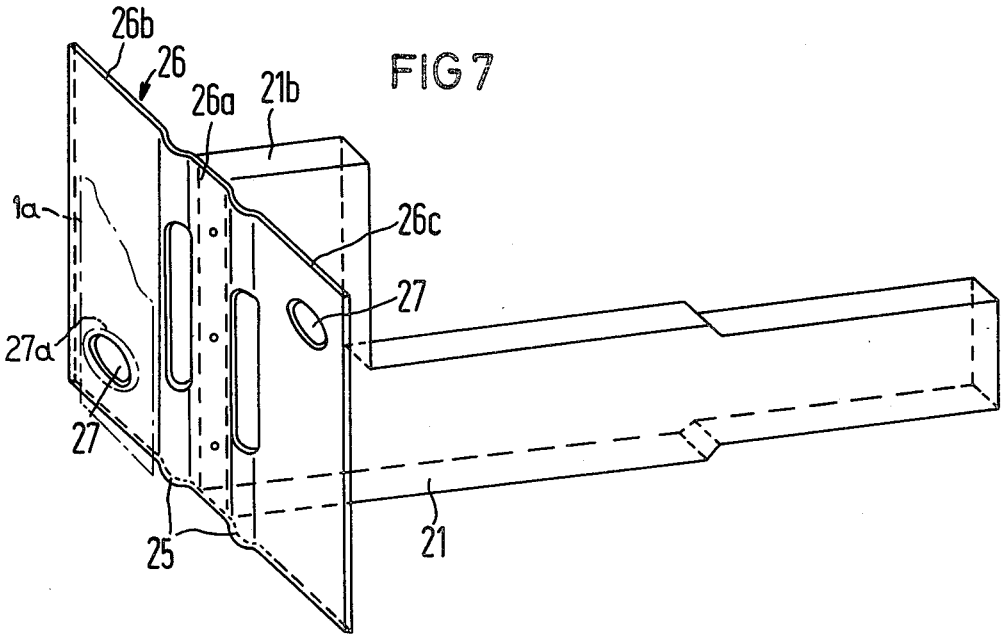
FIG. 7 is a perspective view of a second embodiment of an armature and bearing spring constructed in accordance with the principles of the present invention.

A modified embodiment of the bearing spring 22 is shown in FIG. 7, with the armature 21 being identical to that shown in FIG. 6. Apart from the ridges 25, the bearing spring 26 in the embodiment of FIG. 7 is substantially planar. In this embodiment, the armature leg 21*b* is connected to the central portion 26*a* of the bearing spring 26, with lateral arms 26*b* and 26*c* being utilized to connect the bearing spring 26 to the coil body 1 at the coil flange 1*a*. To this end, the lateral arms 26*b* and 26*c* each have oblong apertures 27 therein through which deformable pegs carried on the coil flange 1*a* extend. The pegs are subsequently flattened by thermal deformation so as to hold the spring 26 in place. Because of the oblong shape of the holes 27, the position of the armature 21 relative to the magnetic coupling surfaces of the yoke legs can be undertaken so as to compensate for and balance tolerances.

Figure 8:
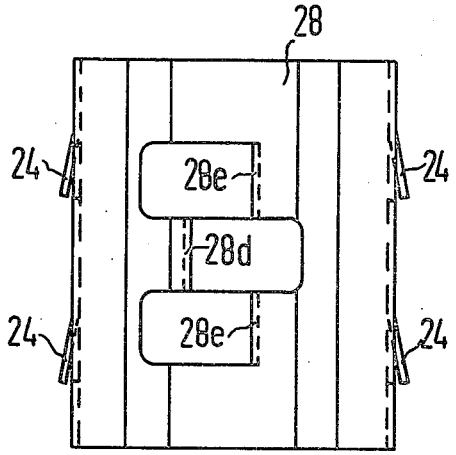
FIG. 8 is an end view of a bearing spring for mounting the armature in a polarized electromagnetic relay constructed in accordance with the principles of the present invention.
Figure 9:
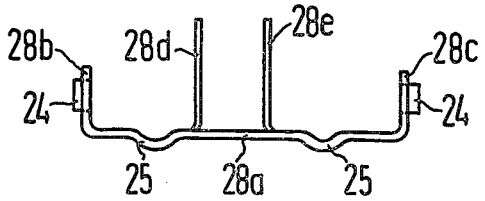
FIG. 9 is a plan view of the bearing spring shown in FIG. 8.

Another modification for the bearing spring is shown in FIGS. 8 and 9. In this embodiment the bearing spring 28 is also U-shaped and has lateral arms 28*b* and 28*c* each having resilient latch tabs 24. In order to fasten the armature to the bearing spring 28 the bearing spring 28 exhibits spring pins 28*d* and 28*e* which are bent toward the interior of the center portion 28*a* of the spring 28. The spring pins 28*d* and 28*e* accept the free end of the armature leg 21*b* therebetween and are secured thereto by any suitable means, such as welding.

Figure 10:
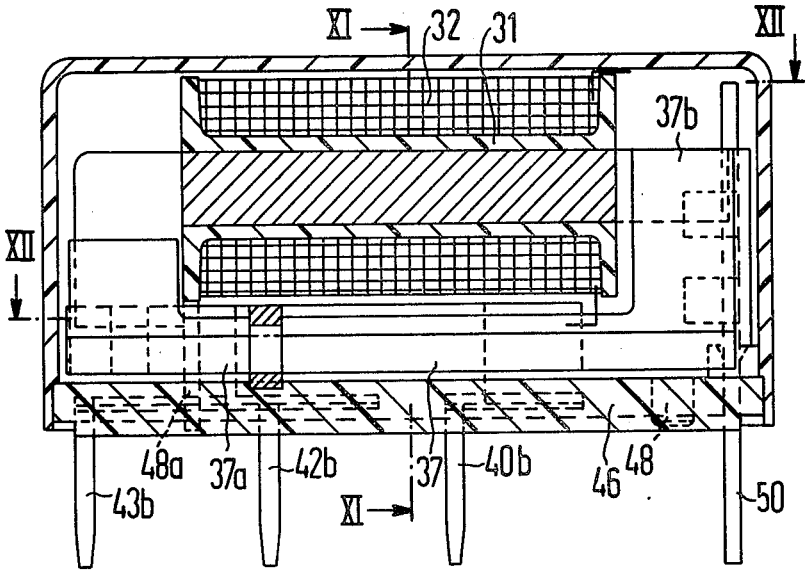
FIG. 10 is a detailed sectional view of a polarized electromagnetic relay constructed in accordance with the principles of the present invention taken along line X—X of FIG. 12.
Figure 11:
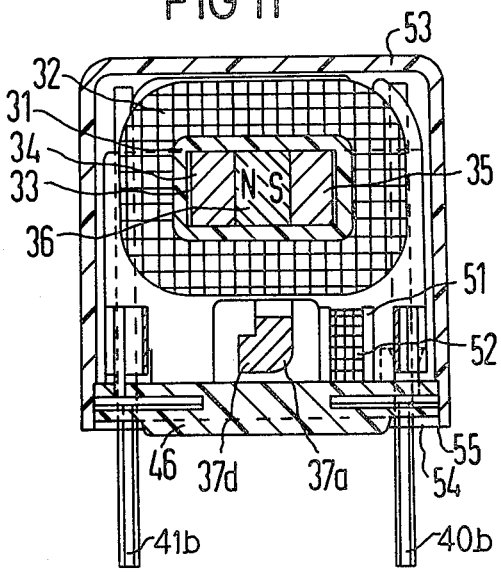
FIG. 11 is a sectional view of a polarized electromagnetic relay constructed in accordance with the principles of the present invention taken along line XI—XI of FIG. 10.
Figure 12:
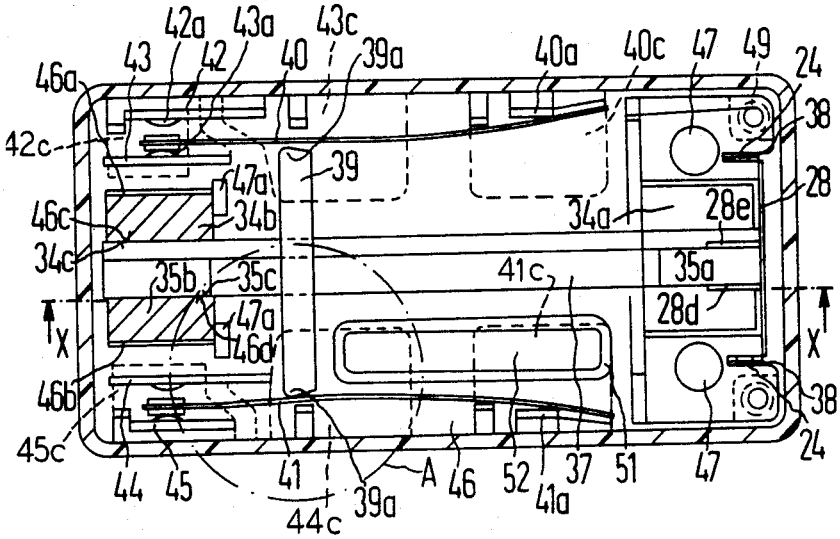
FIG. 12 is a sectional view of a polarized electromagnetic relay constructed in accordance with the principles of the present invention taken along line XII—XII of FIG. 10.

A completely assembled polarized electromagnetic relay constructed in accordance with the principles of the present invention is shown in various sectional views in FIGS. 10 through 12. The long legs 34*a* and 35*a* of two L-shaped yokes 34 and 35 are respectively inserted into an axial passage 33 in a coil body 31 about which a winding 32 is wound. A permanent magnet 36 is disposed between the long yoke legs 34*a* and 35*a* and is also inserted in the passage 33. The permanent magnet 36 is polarized in a direction perpendicular to the interior faces of the yoke legs 34*a* and 35*a* and extends over substantially the entire length of the interior of the coil 32. The yoke legs 34*b* and 35*b* which are angled downwardly outside of the coil body 31 extend substantially perpendicular to the coil axis along the coil flange 31*b* and form two pole surfaces 34*c* and 35*c* for an armature 37.

The armature 37 is also L-shaped, having a long leg 37*a* disposed below the coil 32 and terminating in a free end disposed between the yoke legs 34*b* and 35*b* for executing switching movements in the air gaps formed thereby. The armature 37 has a short leg 37*b* which is disposed between the free ends of the yoke legs 34*a* and 35*a*. As shown in FIG. 12, the armature leg 37*b* is coupled to the yoke leg 35*a* at one side so that this relay exhibits a monostable switching behavior. In the rest condition, the free armature end rests against the yoke leg 34*b*. In the energized or excited state shown in FIG. 12, the armature 37 rests flat against the yoke leg 35*b* in the working position.

As best seen in the sectional illustration in FIG. 11, the armature leg 37*a* has an angled cross-section with an angled arm 37*d* for obtaining a sufficiently large flux guidance cross-section with a reduced overall relay height. The armature 37 is fastened at its short leg 37*b* to an armature spring 28 as shown in FIGS. 8 and 9. The armature 37 is secured between the spring pins 28*d* and 28*e* by means of spot welding. The armature spring 28 is inserted into slots 38 in the coil body flange 31*a* and is held therein by means of resilient latch tabs 24. The armature 37 has an extrusion-coated slide element 39 mounted thereon for actuating two center contact springs 40 and 41 having contact-carrying free ends which are respectively switched between cooperating stationary contact elements 42 and 43, and stationary contact elements 44 and 45. The cooperating contact elements 42, 43, 44 and 45 are anchored in a base body 46, as are the contact mounts 40*a* and 41*a* for the contact springs 40 and 41, and are connected to respective solder pins or terminals. Terminals 40*b*, 42*b* and 43*b* are visible in FIG. 10 and it will be understood that corresponding terminals for the other contact elements are disposed behind the visible terminals, such as 41*b* which can be seen in FIG. 11. All of the terminals project downwardly from the base body 46. The contact elements and the solder terminal pins are stamped in common from a blank piece of stock and are embedded in one plane in the base body 46 with respective center sections 40*c*, 41*c*, 42*c*, 43*c*, 44*c* and 45*c*. Of these embedded center sections, the terminal pins are bent downwardly and the contact spring mounts 40*a* and 41*a* and the contact carriers 42 through 45 are bent upwardly. The actual electrical contacts, such as contacts 42*a* and 43*a*, can be mounted on the contact carriers before or after embedding.

The coil body 31 is secured to the base body 46 together with the yoke elements 34 and 35 and the armature 37. To this end, recesses 46*a* and 46*b* are provided in the base body 46 into which the ends of the yoke legs 34*b* and 35*b* are inserted so that the armature stroke is precisely limited by the seating walls 46*c* and 46*d*, whereby the movement of the spring contacts 40 and 41 is correspondingly precisely limited. The base body 46 also has passages 47 and 47*a* for receiving respective fastening pegs 48 and 48*a* which are formed on the coil body 31. The pegs 48 and 48*a* can be thermally deformed after assembly in order to achieve a rigid connection between the base body 46 and the coil body 31. The base body 46 also has passages 49 for receiving the coil terminal pins 50 and anchoring those pins in the coil body 46. A getter receptacle 51 is also formed on the base body 46 for receiving a liquid getter 52. The getter material is introduced in liquid form and solidifies into a gettering mass. The receptacle 51 may be in the form of retaining ridges for use with solid getter in tablet form. After assembly of the magnetic system with the coil body 31 on the base body 46, a housing cap 53 comprised of synthetic material is put in place over the base body 46. The seam between the base body 46 and the cap 52 as well as the passages 49 are subsequently sealed by casting compound 54.

The optimum use of the available space in the relay disclosed and claimed herein can best be seen in FIG. 11. The coil fills the upper space of the relay, exhibiting an essentially rectangular cross-section as a result of the inserted yoke legs 34*a* and 35*a* with the permanent magnet 36 disposed therebetween. The coil 32 abuts the cap 53 at three sides so that the heat from the coil 32 can be dissipated over a large external surface. The long armature leg 37*a* is disposed below the coil between the contact elements so that the space below the coil 32 is also optimally utilized. Because of the short passages through the base body 46, the contact pairs require little space and exhibit low contact circuit resistances.

Figure 13:
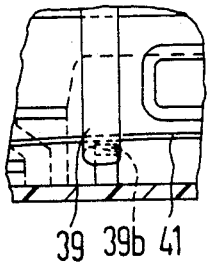
FIG. 13 is a detailed fragmentary view of a second embodiment for engaging the slide contact and the contact springs in a polarized electromagnetic relay constructed in accordance with the principles of the present invention corresponding to area A in FIG. 12.

As described above, the movement of the armature 37 actuates the contact springs 40 and 41 by means of the extrusion-coated slide element 39. To this end, the slide element 39 may have noses 39*a* at each side thereof for engagement with the contact springs 40 and 41. A further embodiment for the contact slide 39 is shown in the fragmentary view in FIG. 13 which is a modification of the portion of the relay designated at A in FIG. 12. In the embodiment of FIG. 13, the slide 39 has apertures at each side thereof in which the contact springs 40 and 41 are respectively seated. The contact springs 40 and 41 are thus force-guided during both closing and opening of the relay switches, so that fused contacts may be pulled apart by actuation of the relay.

Figure 14:
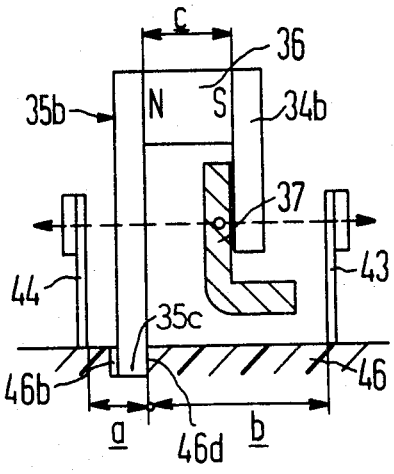
FIG. 14 is an end view of an embodiment of the magnetic circuit for a polarized electromagnetic relay constructed in accordance with the principles of the present invention showing relative spacing between the elements of the magnetic circuit and stationary contacts of the relay.

An end view of selected elements of the relay is shown drawn to scale in FIG. 14 so as to depict the relationship between the armature stroke and the spacing of the contact elements. The extended end 35*c* of the yoke leg 35*b* is inserted in the recess 46*b* in the base body 46 and presses against the edge 46*d* at one side of the recess. This seating edge 46*d* is generated during the manufacture of the base body 46 with a precise spacing a relative to the contact element 44 and a precise spacing b relative to the contact element 43. Thus, the contact elements also exhibit a precise spacing relative to the inside edge of the yoke leg 35*b* which simultaneously forms a stop for the armature 37 in the rest position. Because the yoke leg 34*b* exhibits a precise spacing c relative to the yoke leg 35*b* across the permanent magnet 36, the armature 37 also exhibits a precisely fixed spacing with respect to the contact elements 43 and 44 in the working position shown in FIG. 14. Both yoke legs 34*b* and 35*b* may optionally be inserted in the base body 46, as shown in FIG. 12.

Figure 15:
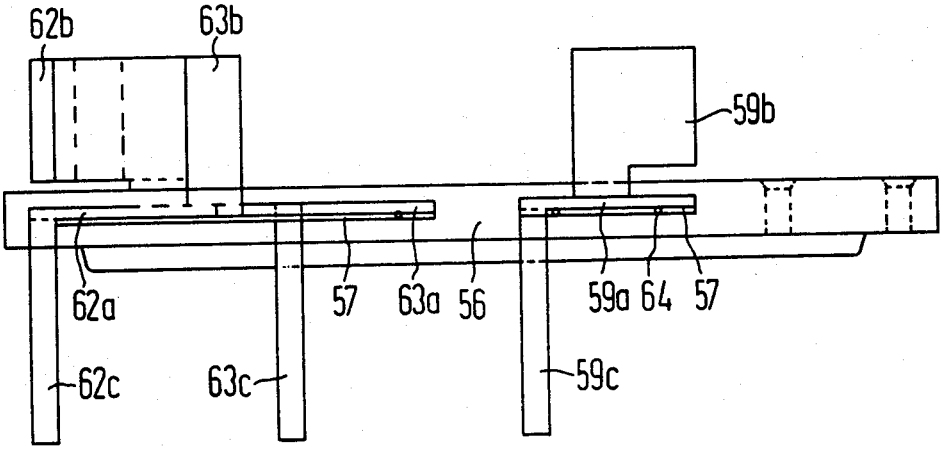
FIG. 15 is a side view of a base body for use in a polarized electromagnetic relay constructed in accordance with the principles of the present invention.
Figure 16:
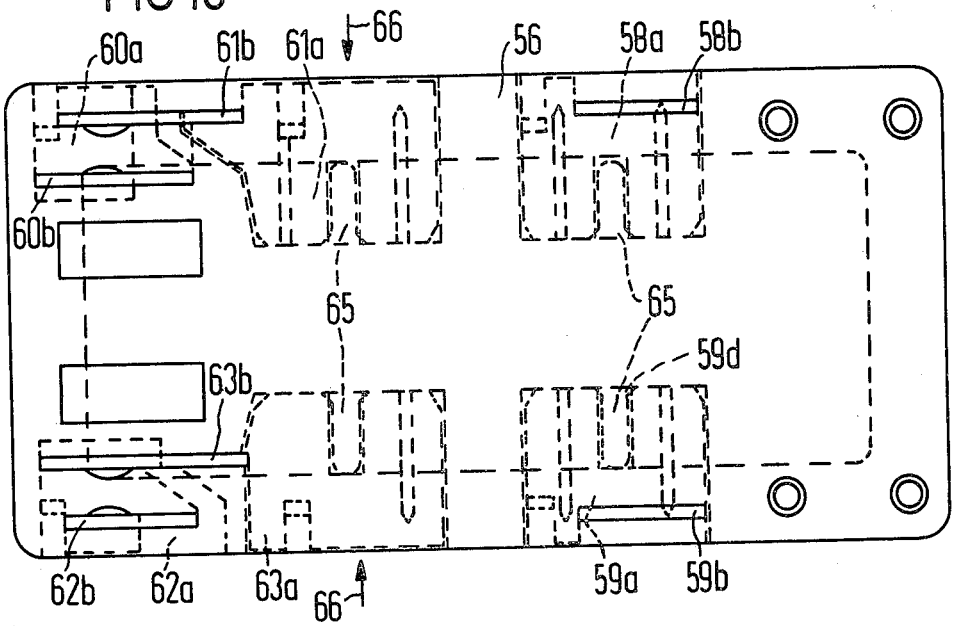
FIG. 16 is a plan view of the base body shown in FIG. 15.

A modified base body 56 is shown in FIGS. 15 and 16 in which the contact elements are secured by plugging. The base body 56 has apertures 57 which are open toward the side of the base body 56 into which spring carriers 58 and 59 and cooperating contact elements 60, 61, 62 and 63 are plugged in the direction of arrows 66. A tight fit is achieved by ribs 64 which are formed on the base body 56. The contact elements are in a form similar to the embedded contact elements described above. Each has a pluggable center portion 58*a*, 59*a*, 60*a*, 61*a*, 62*a* and 63*a* as well as spring carriers 58*b* and 59*b* and contact elements 60*b* and 63*b* which are bent toward the top of the base body 56.

Terminal pins 58*c* through 63*c* are bent toward the bottom of the base body 56. In order to better laterally fix the elements, fastening parts 58*a* through 63*a* have respective cut-outs 58*d* through 63*d* which are held by means of ribs 65 formed on the base body 56 by means of press fit. The base body 56 is connected to the coil body 31 in the same manner as the base body 46.

Figure 17:
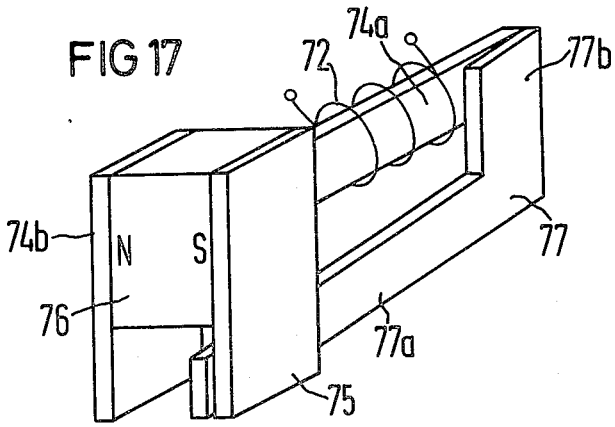
FIG. 17 is a perspective view of a magnet system constructed in accordance with the principles of the present invention for use in a polarized electromagnetic relay.
Figure 18:
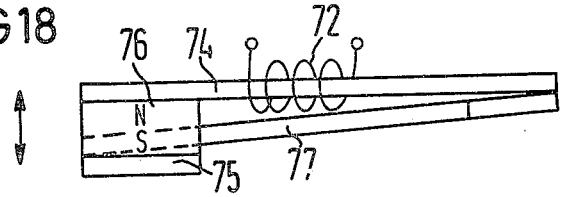
FIG. 18 is a plan view of the magnet system shown in FIG. 17.

A further embodiment of the magnetic system of the relay disclosed and claimed herein is shown in FIGS. 17 and 18. This embodiment is of a simplified construction, however, is less sensitive than the relay described above. In this embodiment the yoke arrangement is also angled and forms a rectangle with the L-shaped armature. In this embodiment, however, both yoke elements are not parallelly mounted over their entire length. Only yoke element 74 has a long leg 74*a* which extends through the coil 72. The armature 77 is magnetically coupled to the long leg 74*a* by means of a short armature leg 77*b*. The short leg 74*b* of the yoke 74 is disposed obliquely in front of the coil 72 so that the yoke 74 has a T-shape. The yoke 75 has only one leg which is disposed parallel to the short yoke leg 74*b* and which, in combination therewith, encloses a permanent magnet 76. The free ends of the yoke elements 74 and 75 form a working air gap with the long armature leg 77*a* which executes switching movement therebetween. Because only one yoke leg 74*a* is conducted through the coil 72, the system is relatively insensitive and can only be utilized for monostable switching. In a rest position, the armature leg 77*a* rests against the yoke 75.

Although modifications and changes may be suggested by those skilled in the art it is the intention of the inventor to embody within the patent warranted hereon all changes and modifications as reasonably and properly come within the scope of his contribution to the art.

I claim as my invention:

1. A polarized electromagnetic relay comprising:

a coil having a hollow interior wound on a coil body;

a yoke arrangement mounted on said coil body consisting of two spaced parallel yoke elements and a permanent magnet disposed between said yoke elements, each yoke element having a short yoke leg and at least one of said yoke elements additionally having a long yoke leg, said long yoke leg of said yoke element extending through said hollow interior of said coil; and an L-shaped armature having a long armature leg extending outside of said coil substantially parallel to said long yoke leg and having a short armature leg disposed substantially perpendicularly relative to the longitudinal axis of said coil such that said armature and said yoke arrangement form a rectangle, said short armature leg forming an axis of rotation for said armature and being connected to said coil body by a bearing means such that a free end of said long armature leg is movable between said yoke elements.

2. The relay of claim 1 wherein both of said yoke elements are L-shaped and each have a long yoke leg and a short yoke leg and wherein said free end of said armature is movable between the free ends of said short yoke legs.

3. The relay of claim 2 wherein said short armature leg is centrally disposed between the free ends of said long yoke legs.

4. The relay of claim 3 wherein the free ends of said long yoke legs of said yoke elements are bent toward said armature in a region of magnetic coupling with said armature.

5. The relay of claim 2 wherein said permanent magnet is disposed between said long legs of said yoke elements and extends through said hollow interior of said coil substantially over the entire length of said coil.

6. The relay of claim 1 wherein said L-shaped yoke element and said armature have identical dimensions.

7. The relay of claim 1 wherein said armature is asymmetrically mounted with respect to said yoke elements against one of said yoke elements.

8. The relay of claim 7 wherein said short yoke legs each have a pole surface thereon and wherein the short yoke legs and the respective pole surfaces thereon are of different size.

9. The relay of claim 8 wherein the short yoke leg of said one of said yoke elements against which said armature is mounted has a smaller pole surface than the pole surface on the short yoke leg of the other of said yoke elements.

10. The relay of claim 8 wherein said long armature leg is laterally angled so as to extend below the smaller of said short yoke legs.

11. The relay of claim 1 wherein said permanent magnet and one of said yoke elements are positioned outside of said coil.

12. The relay of claim 11 wherein said yoke element having said long yoke leg is T-shaped and wherein said short yoke leg of said T-shaped yoke element is disposed outside of said coil perpendicular to said longitudinal coil axis.

13. The relay of claim 1 wherein said long armature leg is disposed below said coil.

14. The relay of claim 1 wherein said bearing means is a bearing spring connecting said short leg of said armature to said coil body.

15. The relay of claim 14 wherein said bearing spring is U-shaped and has a central portion connected to said armature and a pair of spaced lateral arms, and wherein said coil body has a pair of spaced recesses for receiving said lateral arms of said bearing spring.

16. The relay of claim 15 wherein said lateral arms of said bearing spring each have at least one resilient latching tab for securing said lateral arms in said recesses.

17. The relay of claim 14 wherein said bearing spring is planar and has a central section connected to said armature and has at least one aperture disposed at each side of said armature, and wherein said coil body has deformable pegs mounted thereon in registry with each of said apertures for engaging said apertures for holding said bearing spring against said coil body upon deformation of said pegs.

18. The relay of claim 17 wherein said apertures are oblong holes.

19. The relay of claim 14 wherein said armature is symmetrically mounted with respect to said central portion of said bearing spring for bistable switching.

20. The relay of claim 14 wherein said armature is asymmetrically mounted with respect to said central portion of said bearing spring for monostable switching.

21. The relay of claim 14 wherein said bearing spring has a plurality of impressed ridges thereon extending substantially parallel to said short armature leg.

22. The relay of claim 1 further comprising:

a relay base body comprised of insulating material and disposed below said coil body and having a plurality of passages; and said coil body about which said coil is wound having a plurality of deformable pegs in registry with said passages in said base body for attaching said coil body to said base body.

23. The relay of claim 22 further comprising a plurality of contact terminal elements embedded in said base body.

24. The relay of claim 21 further comprising a plurality of contact terminal elements pluggably anchored in said base body.

25. The relay of claim 22 further comprising a plurality of terminal elements anchored in a common plane in said base body, each of said terminal elements including an exposed section bent downwardly for use as a terminal pin and an exposed section bent upwardly for use as a contact carrier or spring carrier respectively.

26. The relay of claim 21 wherein said relay further comprises a plurality of stationary contact carriers mounted on said base body and wherein said base body has a recess for receiving at least one short yoke leg such that said short yoke leg rests against a seating wall of said recess for precisely fixing the spacing between said yoke arrangement and said contact carriers.

27. The relay of claim 21 wherein said base body has a receptacle for receiving and holding getter material.

28. The relay of claim 27 wherein said getter material is introduced into said receptacle in liquid form.

29. The relay of claim 1 further comprising:

at least one spring contact element; and a contact slide carried on said armature and extrusion-coated with insulating material for actuating said spring contact.

30. The relay of claim 29 wherein said contact slide has at least one recess for receiving said contact spring for forced guidance of said contact spring in two directions.

* * * * *